US009855764B2

(12) United States Patent
Yamamoto et al.

(10) Patent No.: US 9,855,764 B2
(45) Date of Patent: Jan. 2, 2018

(54) RECORDING APPARATUS, RECORDING SYSTEM, AND RECORDING METHOD

(71) Applicant: CANON KABUSHIKI KAISHA, Tokyo (JP)

(72) Inventors: Naomi Yamamoto, Yokohama (JP); Masashi Oya, Soka (JP); Makoto Torigoe, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/948,592

(22) Filed: Nov. 23, 2015

(65) Prior Publication Data

US 2016/0144630 A1 May 26, 2016

(30) Foreign Application Priority Data

Nov. 25, 2014 (JP) ..... 2014-238251

(51) Int. Cl.
*B41J 2/21* (2006.01)
*B41M 7/00* (2006.01)
*B41J 11/00* (2006.01)

(52) U.S. Cl.
CPC ..... *B41J 2/2114* (2013.01); *B41J 11/0015* (2013.01); *B41M 7/0045* (2013.01)

(58) Field of Classification Search
CPC .... B41J 2/2114; B41J 11/0015; B41M 7/0045
See application file for complete search history.

(56) References Cited

U.S. PATENT DOCUMENTS 7,794,077 B2 * 9/2010 Falser ..... B41J 2/1433 101/183
2003/0189626 A1 * 10/2003 Kataoka ..... C09D 11/30 347/98
2003/0193553 A1 * 10/2003 Issler ..... C09D 11/40 347/100

(Continued)

FOREIGN PATENT DOCUMENTS

JP 2008-213271 A 9/2008
JP 2011-180391 A 9/2011
JP 2012-40837 A 3/2012

*Primary Examiner* — Manish S Shah
*Assistant Examiner* — John P Zimmermann
(74) *Attorney, Agent, or Firm* — Canon U.S.A., Inc. IP Division

(57) ABSTRACT

To apply color ink to a region in which application of a glossiness adjusting liquid is completed, a recording apparatus includes a first application unit provided with a nozzle for ejecting color ink and configured to eject the color ink from the nozzle to apply to a recording medium to record an image on the recording medium, and a second application unit configured to apply a substantially transparent adjusting liquid to the recording medium to adjust a degree of surface roughness of the image formed on the recording medium, wherein after the adjusting liquid is applied to a first region of the recording medium by a predetermined times of relative movement between the second application unit and the recording medium, a relative movement between the first application unit and the recording medium for applying the color ink to the first region is started.

8 Claims, 17 Drawing Sheets

(56) References Cited

U.S. PATENT DOCUMENTS

| | | | | |
|---|---|---|---|---|
| 2005/0156964 | A1* | 7/2005 | Hoshino | B41J 29/393 347/9 |
| 2005/0156965 | A1* | 7/2005 | Hoshino | B41J 2/2132 347/9 |
| 2006/0158481 | A1* | 7/2006 | Spevak | B41J 2/2114 347/43 |
| 2010/0194838 | A1* | 8/2010 | Mitsuzawa | B41J 2/2114 347/102 |
| 2011/0096120 | A1* | 4/2011 | Taya | B41J 2/15 347/20 |
| 2012/0287190 | A1* | 11/2012 | Shimada | B41J 2/2114 347/12 |
| 2013/0120482 | A1* | 5/2013 | Nishikawa | B41J 2/2114 347/9 |
| 2013/0300785 | A1* | 11/2013 | Tsuchiya | B41J 2/21 347/7 |
| 2015/0124031 | A1* | 5/2015 | Iijima | B41J 2/2114 347/102 |

* cited by examiner

RECORDING APPARATUS, RECORDING SYSTEM, AND RECORDING METHOD

BACKGROUND OF THE INVENTION

Field of the Invention

The present disclosure generally relates to recording and, more particularly, to a recording apparatus, a recording system, and a recording method.

Description of the Related Art

Various objects have attributes that can be expressed by subjective quantities of sense, such as color, smell, and tactile feeling. At the same time, objects also have an attribute of complex feelings expressed as a texture. Regarding a texture related to a recorded matter, such an attribute often refer to textures like color tone and glossiness of a recorded matter, and a surface shape and a material of a recording medium (hereafter, referred to as "texture"). In a recorded matter recorded, for example, by inkjet recording, a texture of the recording medium itself contributes greatly to a texture of the final recorded matter.

In the inkjet recording in which an image is recorded with ink, ejected from a recording head, applied to a recording medium and forming dots, user's ideas and artistic quality can be expressed by forming images on various recording media by taking advantage of the non-contact recording. As described above, recording media of various textures is sold in the market because the texture of the recording medium contributes greatly to the texture of the final recorded matter. Recording media with unique texture for inkjet printing, such as Japanese paper and canvas, also exist. What kind of expression is performed on the recorded matter is related closely to what kind of recording medium is to be selected and, therefore, selection of the recording medium is important for the user's creative expression.

A texture is recognized as a combination of various feelings, and the recognized texture is dependent on the combined feeling elements. Hereinafter, a texture refers to that resulting from glossiness or surface roughness contributing greatly to an appearance of a recorded matter.

In the related art recording with an inkjet recording apparatus using aqueous ink, recording while changing a texture of a recording medium has been difficult. However, as methods for changing glossiness and textures to an extent that a texture of a recording medium is changed, methods using UV ink (see Japanese Patent Laid-Open No. 2012-40837) or electrophotographic toner control (see Japanese Patent Laid-Open No. 2011-180391) are known. These techniques, however, need to make the thickness of coated layers different to considerable degrees, and products to which these techniques can be applied are very expensive. In the related art aqueous inkjet recording apparatuses, making textures related to glossiness different has been tried, and a method for making glossiness different is disclosed in Japanese Patent Laid-Open No. 2008-213271.

SUMMARY OF THE INVENTION

Although it is possible to make glossiness different, the range of glossiness controllable in Japanese Patent Laid-Open No. 2008-213271 is limited. The present disclosure has found a method for forming an image with a greater difference in glossiness and with a matt texture on a recording medium compared with those of the related art methods.

The present disclosure forms an image with a more matt texture on a recording medium.

An aspect of the present disclosure provides a recording apparatus which includes a first application unit provided with a nozzle for ejecting color ink and configured to eject the color ink from the nozzle to apply to a recording medium to record an image on the recording medium, and a second application unit configured to apply a substantially transparent adjusting liquid to the recording medium to adjust a degree of surface roughness of the image formed on the recording medium, wherein after the adjusting liquid is applied to a first region of the recording medium by a predetermined times of relative movement between the second application unit and the recording medium, a relative movement between the first application unit and the recording medium for applying the color ink to the first region is started.

Further features of the present disclosure will become apparent from the following description of exemplary embodiments with reference to the attached drawings.

DESCRIPTION OF THE EMBODIMENTS

Hereinafter, embodiments of the present disclosure are described in detail. Before describing specific embodiments of the present disclosure, glossiness and a matt texture based thereon in the embodiment are described.

Glossiness

Glossiness of a recording medium is controlled in the embodiments of the present disclosure. Glossiness is evaluated in the gloss value, haze, and image clarity. Objects with glossiness can be evaluated with these indices.

The gloss value and haze are evaluated by using B-4632 (Japan name: Micro Haze Plus) manufactured by BYK-Gardner. The gloss value is detected at 1.8° at an opening width of the detector according to the central axis of the reflected light, and the haze is detected in the range up to ±2.7° outside thereof. In the measurement of reflected light, the gloss value is defined by reflectance, with respect to incident light, of regular reflection light which forms the central axis of the regular reflection light, and haze is defined by measured scattered light produced in the vicinity thereof.

Image clarity, representing clearness of an image recorded on a recording medium, is measured, for example using JIS H8686 "image clarity measuring method on anodic oxide coating of aluminum and aluminum alloy." If, for example, an image of illumination on a recording medium is blurred, a value of image clarity becomes low.

Definition of Matt Texture

In the present disclosure, providing a glossy recording medium with a matt texture is referred to as "providing a matt texture." Providing a matt texture indicates lowering in gloss intensity or the value of gloss image clarity when the glossiness of a recording medium is measured using a commercially available gloss measurement apparatus. Regarding reflected light of light incident on paper, a ratio of a regular reflection light component is high if the gloss value is high, whereas a ratio of a diffuse light component is high if the paper is matt. This means that above-described haze is large in amount.

Here, an exemplary inkjet recording apparatus in which the present disclosure is implementable is described.

Configuration of Apparatus

Figure 13A:
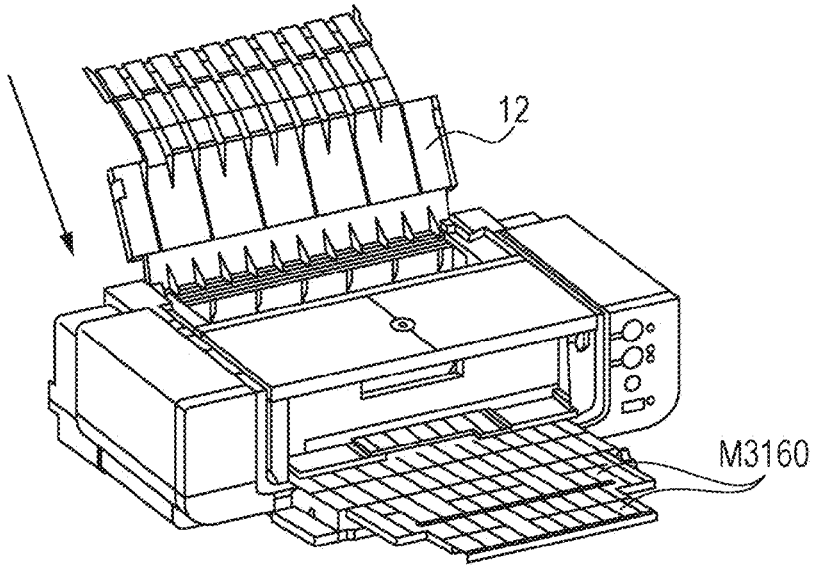
FIGS. 13A and 13B illustrate the entire recording apparatus according to an embodiment.
Figure 13B:
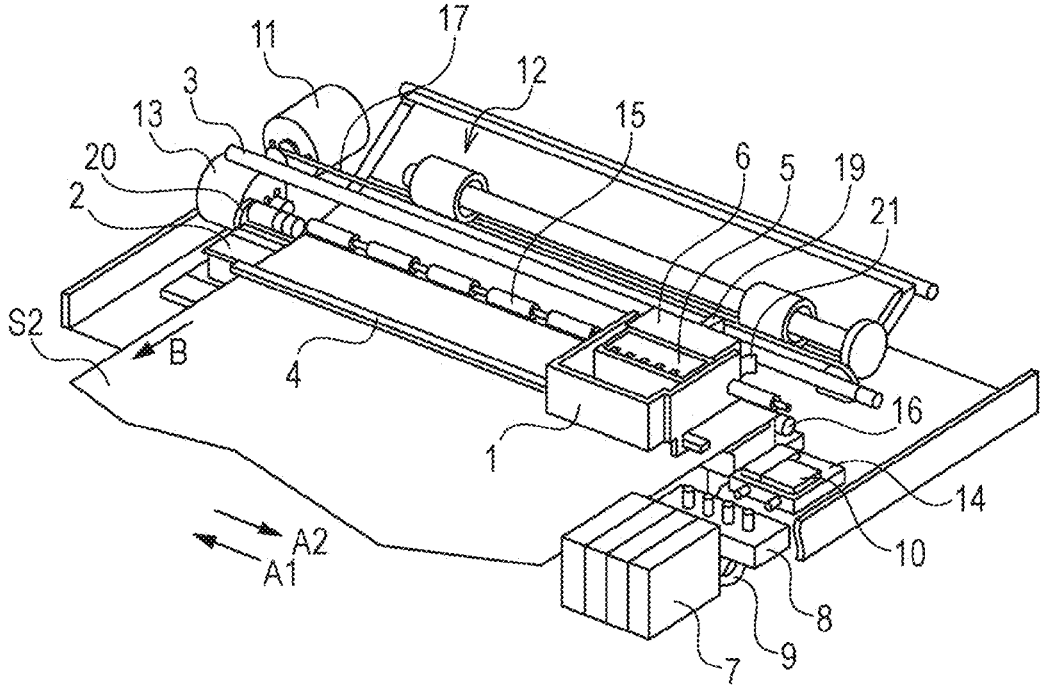

FIG. 13A is a perspective view illustrating an exterior of an inkjet recording apparatus to which the embodiment of the present disclosure is applied. FIG. 13B is a perspective view illustrating the inside of the inkjet recording apparatus.

A recording method of the embodiment of the present disclosure is implementable in the recording apparatus as illustrated in FIG. 13A that ejects a glossiness adjusting liquid. In the recording apparatus of FIG. 13A, a recording medium is inserted in the arrow direction from a feed tray 12, conveyed intermittently during which an image is formed thereon, and then discharged on a discharge tray M3160. In FIG. 13B, a recording head 5 mounted on a carriage 1 ejects ink through nozzles while reciprocating along as guide rail 4 in directions of arrows A1 and A2, and forms an image on a recording medium S2. A recording head 1 has a plurality of nozzle groups corresponding, for example, to ink of different colors and a glossiness adjusting liquid. For example, the nozzle groups are for ejecting color ink of 5 colors described later (cyan (C), magenta (M), yellow (Y), black (K), and gray (Gy)) and colorless and transparent glossiness adjusting liquid (CL). The color ink and the glossiness adjusting liquid are stored in ink reservoirs (not illustrated) and are supplied to the recording head 1 therefrom. In the nozzle array, a plurality of nozzles through which the ink and the glossiness adjusting liquid are ejectable are arranged in a direction to cross the main scanning direction (in this example, the direction perpendicularly cross the main scanning direction). An electrothermal transducer (i.e., a heater), a piezoelectric element, or the like an ejection energy generation element for generating ejection energy of ink is provided to correspond to the nozzles arranged in the predetermined direction. If an electrothermal transducer is used, the ink is foamed when the electrothermal transducer is heated, and is ejected through ejection ports of nozzle tips with foaming energy.

In this embodiment, the ink reservoir and recording head 1 integrally form a print head cartridge 6, which is mounted on a carriage 5.

The carriage 5 is made to reciprocate in arrow A1 and A2 directions (i.e., the main scanning direction) along a guide shaft 3 and a guide rail 4 when driving force of a carriage motor 11 is transmitted to the carriage 5 via a timing belt 17. During the movement of the carriage, the carriage position is detected by an encoder sensor 21 provided in the carriage 5 reading a linear scale 19 provided along the moving direction of the carriage. With the reciprocation, recording on the recording medium is started. A recording medium S2 is supplied from the feed tray 12, held between a conveyance roller 16 and a pinch rollers 15, and is conveyed to a platen 2.

When recording for one scanning event is performed while the recording head 1 is moved in the A1 direction together with the carriage 5, the conveyance roller 16 is driven by a conveyance motor 13 via the linear wheel 20. Then the recording medium S2 is conveyed a predetermined amount in the arrow B direction, which is a sub-scanning direction (i.e., a recording medium conveyance direction). The sub-scanning direction crosses the main scanning direction (in this example, crosses perpendicularly). Then, recording is performed on the recording medium S2 while the carriage 5 is scanned in the A2 direction. In this manner, recording is performed during alternate conveyance of the recording medium and scanning of the carriage. As illustrated in FIG. 13B, a head cap 10 and a recovery unit 14 are provided at a home position for the intermittent recovery of the recording head 1 as needed. As used herein, the term "unit" generally refers to any combination of software, firmware, hardware, or other component, such as circuitry, that is used to effectuate a purpose.

When recording for one sheet of recording medium is completed by repeating the above operation, the recording medium is discharged and recording for one sheet is completed.

Figure 18:
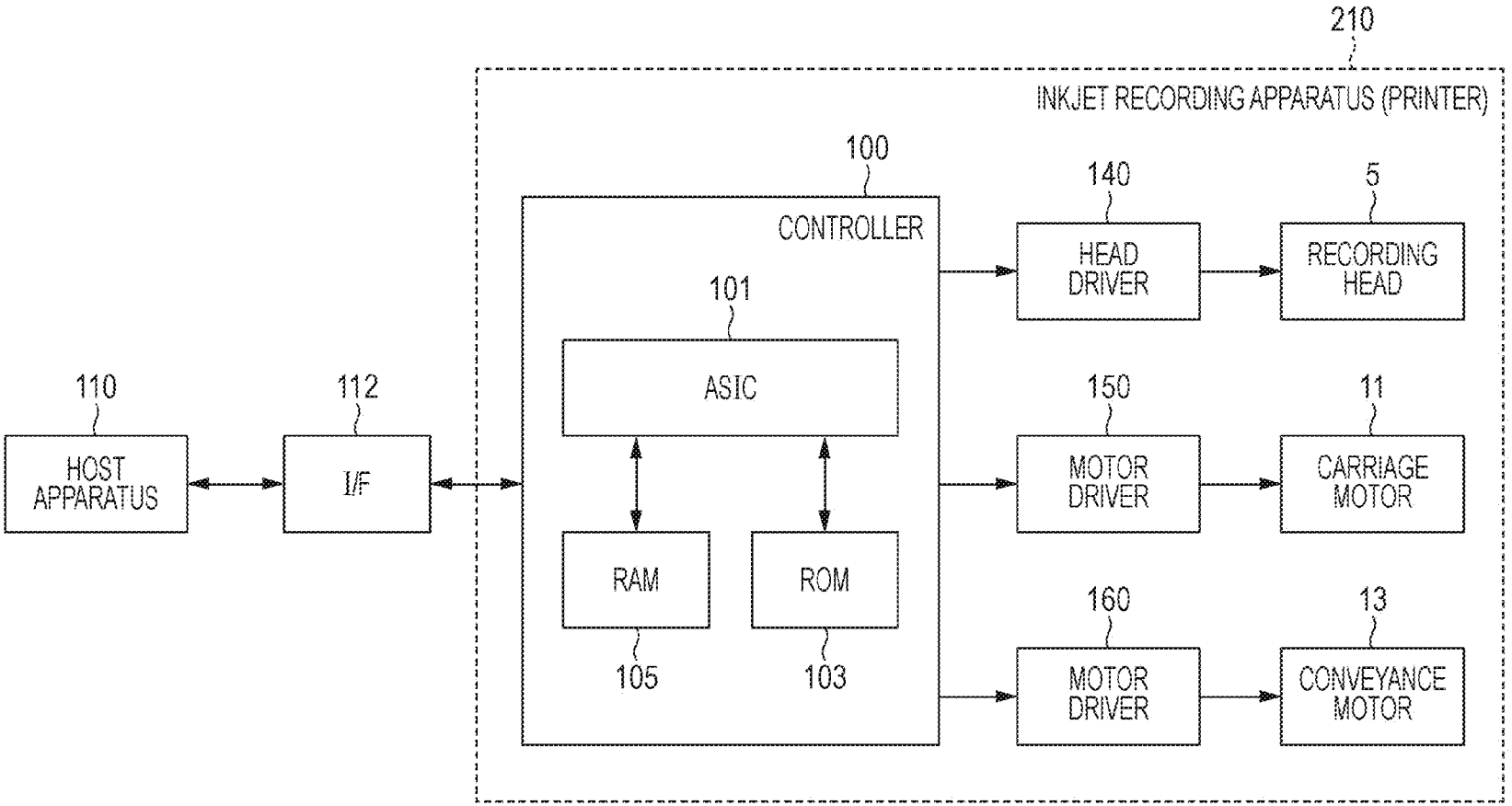
FIG. 18 is a block diagram illustrating a control configuration of a recording system according to an embodiment.

FIG. 18 is a block diagram illustrating a control configuration of the inkjet recording apparatus in the present embodiment. An inkjet recording apparatus 210 includes a controller 100, a head driver 140, and motor drivers 150 and 160.

The controller 100 is a main control unit which includes, for example, an application specific integrated circuit (ASIC) 101 in the form of a microcomputer, read-only memory (ROM) 103, and random access memory (RAM) 105. The ROM 103 stores a dot arrangement pattern, a mask pattern, and other fixed data. The RAM 105 provides a region in which recording data is deployed, or a work space. The ASIC 101 reads a program from the ROM 103 and executes a series of processes until the recording data is recorded on the recording medium. The head driver 140 drives the recording head 5 in accordance with the recording data. The motor driver 150 drives the carriage motor 11, and the motor driver 160 drives the conveyance motor 13.

A host apparatus 110 is a supply source of image data, and which may be a computer that generates data of images related to recording (i.e., recording data), performs processing, and the like, or may be a reader unit for image reading. Details of recording data are described later. The recording data, other commands, status signals, and the like are transmitted to and received from the controller 100 of the inkjet recording apparatus 210 via an interface (I/F) 112. An image processing flow in the inkjet recording apparatus is described later.

Glossiness Adjusting Liquid

Next, an exemplary glossiness adjusting liquid used in the present embodiment is described.

Styrene/acrylic acid copolymer 2 parts
Glycerin 7 parts
Diethylene glycol 5 parts
Water 86 parts A liquid obtained by the above preparation can be used as the glossiness adjusting liquid. Any glossiness adjusting liquids that may provide the same effect can be used. A difference in function between the glossiness adjusting liquid and normal color ink exists in a polymer amount. An example of ink containing a great amount of polymer having a function of adjusting glossiness is the glossiness adjusting liquid. Regarding ink containing a coloring material, if the ink contains a great amount of polymer having the same function and has the same function, that ink can be used in an embodiment of the present disclosure.

A difference in the polymer amount may cause a difference in the recorded liquids on a recording medium. As an effect thereof, the glossiness adjusting liquid containing a greater polymer amount recorded in advance (i.e., as in the present disclosure) prevents subsequently applied color ink from being permeated in, absorbed into, and fixed to the recording medium. Therefore, if the glossiness adjusting liquid is recorded earlier than the color ink, the surface of the subsequently applied color ink becomes roughened, which provides the surface with a matt texture.

The present embodiment employs a typical glossiness adjusting liquid that has a composition excluding a coloring material. Such a glossiness adjusting liquid is transparent. Thus, an influence on the image color is minimized. If the glossiness adjusting liquid contains a coloring material, the color must be adjusted between the portion to which the glossiness adjusting liquid is applied and the portion to which the glossiness adjusting liquid is not applied. The above glossiness adjusting liquid is illustrative only and it is not a purpose to exclude the case in which the coloring material is contained. If the glossiness adjusting liquid contains a coloring material, but the coloring material is substantially transparent to the subsequently applied color ink, such as colorless, or very light color such as yellow, that glossiness adjusting liquid has the same function as that of the glossiness adjusting liquid containing no coloring material of this example. That is, ink containing a proper polymer amount and having the same function with respect to the recording medium can be used. Therefore, ink containing a coloring material and having the same function can be used. The glossiness adjusting liquid does not substantially react with color ink.

First Embodiment

In the present embodiment, a formed image is provided with a matt texture by application of a glossiness adjusting liquid to a recording medium prior to formation of an image with normal ink. First, the phenomenon is described with reference to FIG. 2.

Figure 2:
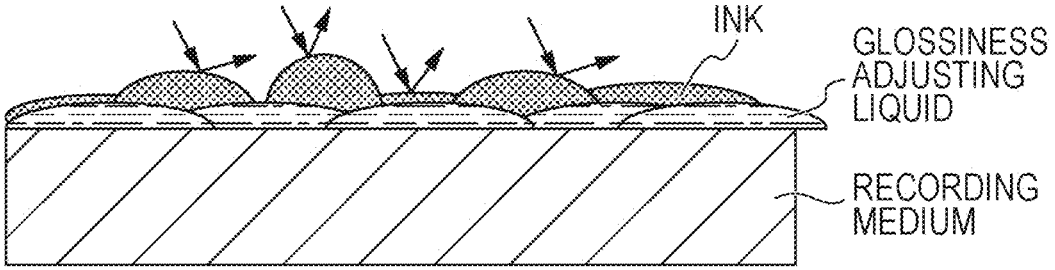
FIG. 2 illustrates a cross section of a recording medium according to a first embodiment.

The glossiness adjusting liquid applied to the recording medium prior to the ink tends to prevent permeation and fixation of the ink into the recording medium due to the function of the polymer contained in the glossiness adjusting liquid. When the color ink for image formation is recorded subsequently, the surface shape is changed since the process described above is different from that of the case where the glossiness adjusting liquid is not recorded. This roughens the surface, and loses glossiness of the surface in both appearance and in measurement value. FIG. 2 illustrates that the existence of the glossiness adjusting liquid makes roughness of ink located above the glossiness adjusting liquid apparent, whereby incident light is scattered.

A method for implementing such a physical phenomenon by a recording method is described.

First, a process flow for generating recording data for the color ink and the glossiness adjusting liquid is described.

Figure 1:
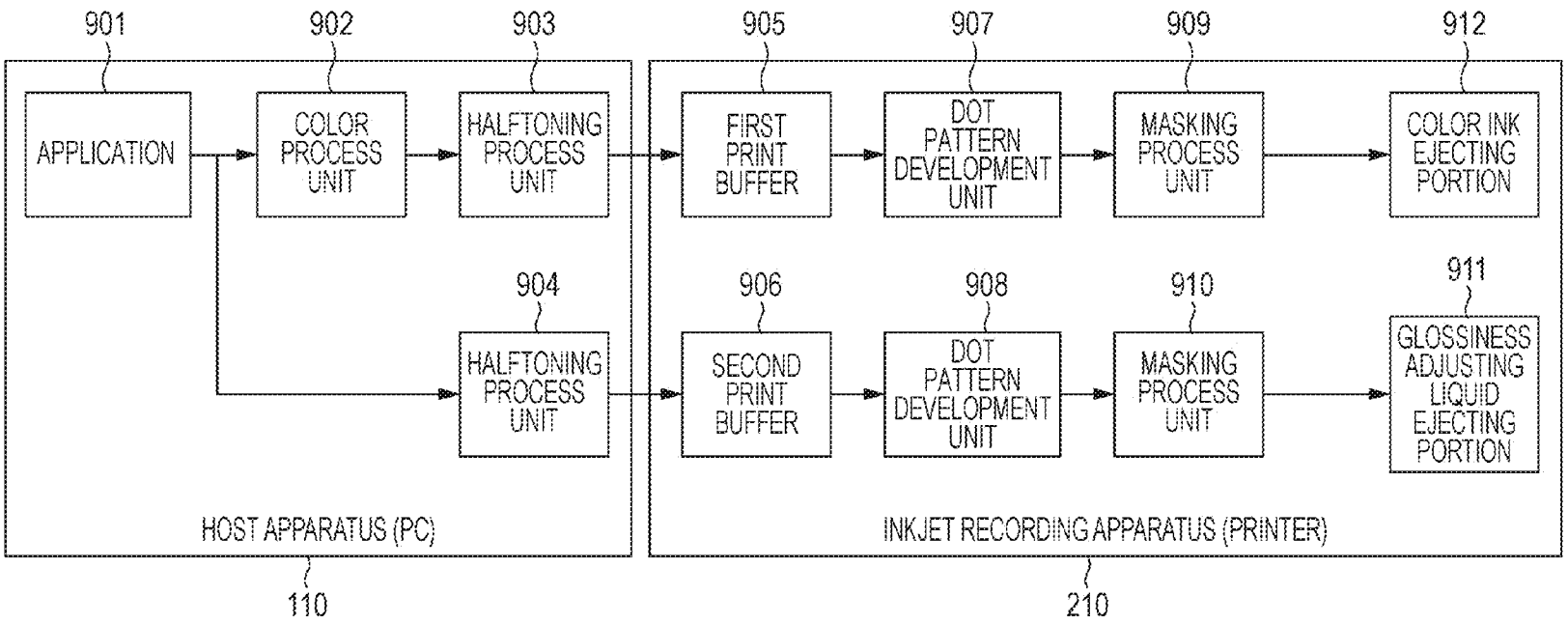
FIG. 1 illustrates a flow of data processing of a recording system according to an embodiment.

FIG. 1 is a block diagram illustrating an image processing configuration in a recording system constituted by an inkjet recording apparatus of the present embodiment and a host apparatus. A process flow for generating recording data for the color ink and the glossiness adjusting liquid is described with reference to FIGS. 1 and 3.

The reference numeral 901 denotes an application on a personal computer (PC). A total of 24 bits of image data (each 8 bits to red, green, blue (RGB)) is input from the application 901 to a color process unit 902. The color process unit 902 converts the RGB image data into signals of color ink to be used in the inkjet recording apparatus. In the present embodiment, five colors of ink are used in the inkjet recording apparatus, but the disclosure is not limited to the same. The signal of the color ink output from the color process unit 902 becomes a total of 84 bits (12 bits for each color) to achieve gradation.

The reference numeral 903 denotes a halftoning process unit. The halftoning process unit 903 performs a pseudo halftone process (i.e., a halftoning process), such as error diffusion, to the 12-bit (=4096 value) multivalued signal of each input color, and converts the signal into data of an N-value lower than that of 4096 value. Specifically, the N-value is, for example, about 3 to 16. Multi-value halftoning of 2 to 4 bits of each color is performed. Although multi-valued halftoning is described in the present embodiment, this is not restrictive and binary halftoning may also be used.

The reference numeral 905 denotes a first print buffer. The processes until the halftoning process are performed by the host apparatus or personal computer (PC) 110, and the subsequent processes are performed by inkjet recording apparatus main body. Therefore, the N-value data that has halftoned by the halftoning process unit 903 is temporality stored in the first print buffer 905 from the PC 110.

Figure 19:
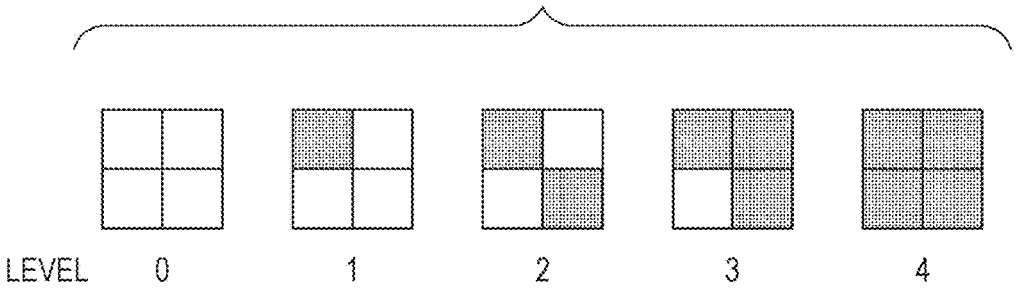
FIG. 19 illustrates a dot pattern according to an embodiment.

The reference numeral 907 denotes a dot pattern development unit. The dot pattern development unit 907 develops the data to N types of gradation dot patterns corresponding to the N-value data input from the first print buffer 905. This example is described with reference to FIG. 19. FIG. 19 illustrates an example in which input 5-value data (Level 0 to 4) is developed into corresponding 2×2 pixel dot patterns. Black pixels are ON in which dots are formed and white pixels are OFF in which dots are not formed.

The reference numeral 909 denotes a masking process unit. Record-scanning in which the recording head is made to scan a plurality of times with respect to the same recording area to record an image is referred to as a multipath recording process. In the multipath recording process, the masking process unit 909 performs a mask process in accordance with the developed dot patterns using a thinning pattern (hereafter, referred to as a mask pattern) to thin out the recording data for each of the scanning events.

Returning to FIG. 1, the process flow for generating the recording data is described. The reference numeral 912 denotes an ejecting portion for color ink of the recording heads 5 of the inkjet recording apparatus. When thinning out is performed in the masking process unit 909, the thinned recording data (i.e., first recording data) about color ink is obtained. The thinned first recording data about color ink is sent to the color ink ejecting portion 912, and the color ink ejecting portion 912 is driven.

Figure 3:
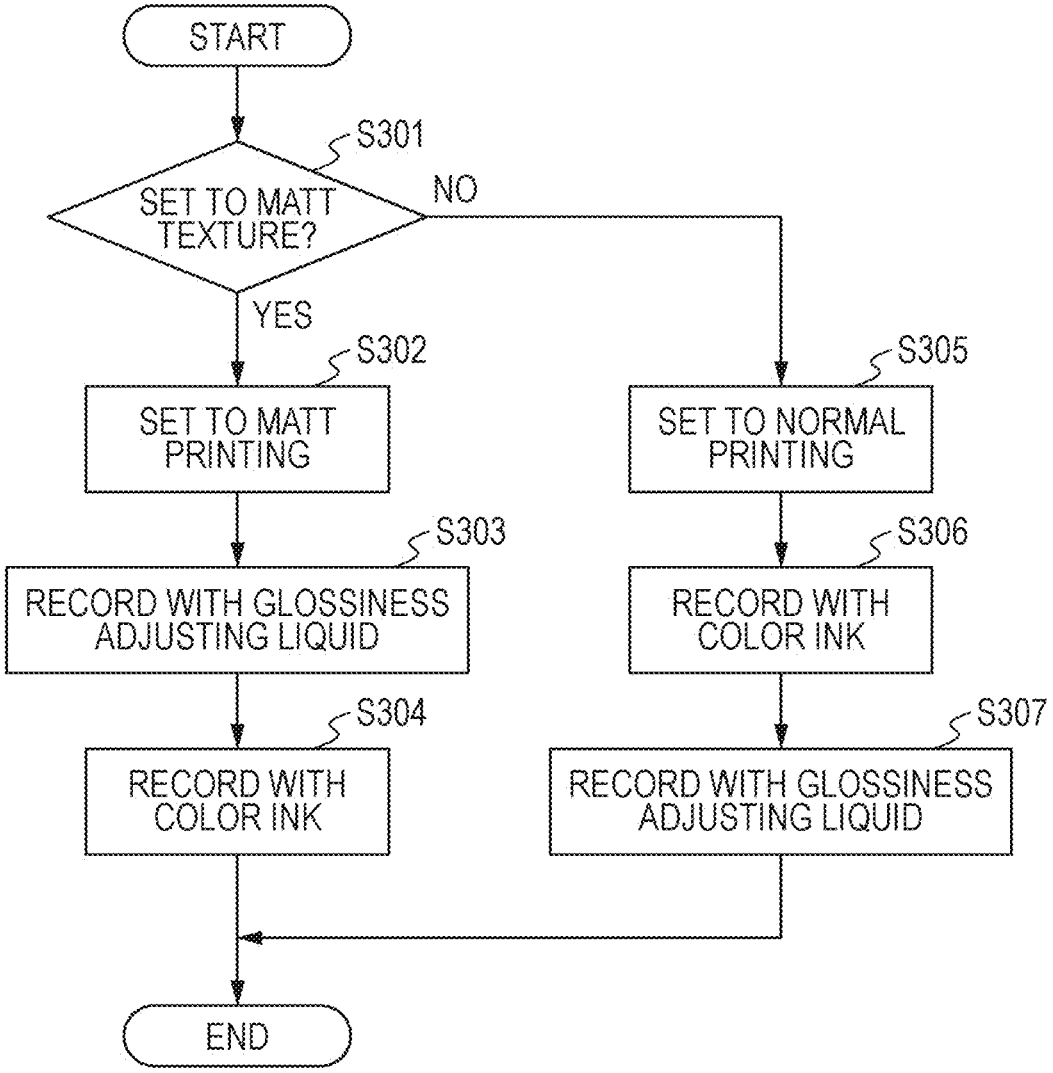
FIG. 3 is a flowchart of a recording method according to the first embodiment.

Next, with reference to FIGS. 1 and 3, a recording method for providing matt texture and a process flow for generating recording data related to the method are described. First, in the host apparatus, a user selects whether a matt texture is employed (S301). When the host apparatus receives an input of performing matt printing, the application 901 sets for the matt printing. Then, with this matt print setting, recording data used for the application of the color ink and the glossiness adjusting liquid for providing a matt texture is generated (S302).

In S302, the recording data is generated by the processes in color process unit 902, the halftoning process unit 903, the first print buffer 905, the dot pattern development unit 907, and the masking process unit 909. The recording data is related to the glossiness adjusting liquid, and is multi-valued data generated separated from ordinary recording data about the color ink using the function of the application 901. In the present embodiment, the multi-valued data corresponds to the shape of the image of the color ink that forms an image reproducing a matt texture. The first recording data about the color ink output from the color process unit 902 was 12 bits in consideration of gradation. Second recording data of the glossiness adjusting liquid, on the contrary, is output as 8-bit data, i.e., 256 tones because fewer steps of gradation are used. The halftoning process unit 904 performs a halftoning process to the multi-value recording data for the input glossiness adjusting liquid and converts the data into an M-value smaller than 256 value. The reference numeral 906 denotes a second print buffer and 908 denotes a dot pattern development unit. Since the function of the second print buffer 906 is the same as that of the first print buffer 905 and the function of the dot pattern development unit 908 is the same as the dot pattern development unit 907 in the flowchart for processing the data of color ink, description thereof is omitted. The reference numeral 910 denotes a masking process unit. Since the function of the masking process unit 910 is the same as that in the flowchart for processing the data of color ink, description thereof is omitted. The recording data for each data scanning processed by the masking process unit 910 is sent to the glossiness adjusting liquid ejecting portion 911 of the recording head 5, and the glossiness adjusting liquid ejecting portion 911 is driven. The print buffers, the dot pattern development units, and the masking process units for both the color ink and the glossiness adjusting liquid are provided as parts of the controller 100 of FIG. 18, and the ASIC performs data processing described above. The mask pattern and the dot development pattern are stored in the ROM 103. The generated recording data is sent to each ejecting portion in the recording head 5 via the head driver 140 (FIG. 18) from the masking process unit.

Figure 16A:
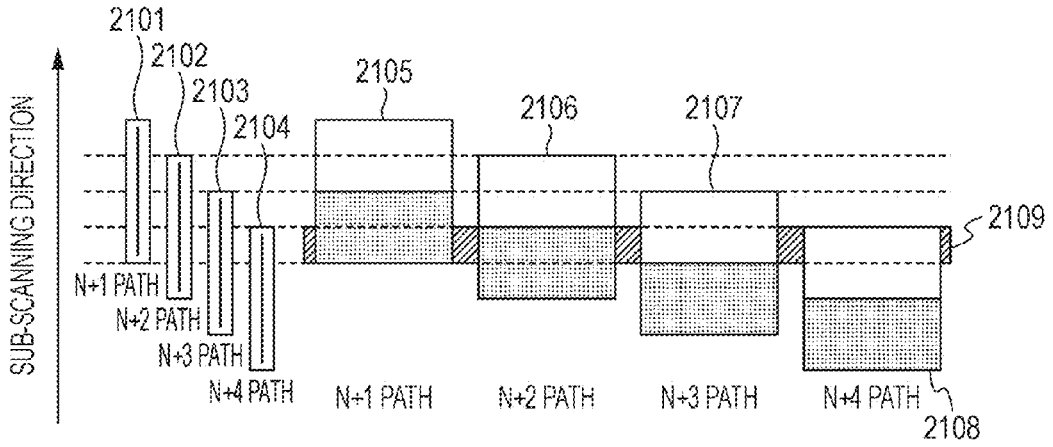
FIGS. 16A and 16B are schematic diagrams illustrating states of multipath recording according to an embodiment.
Figure 16B:
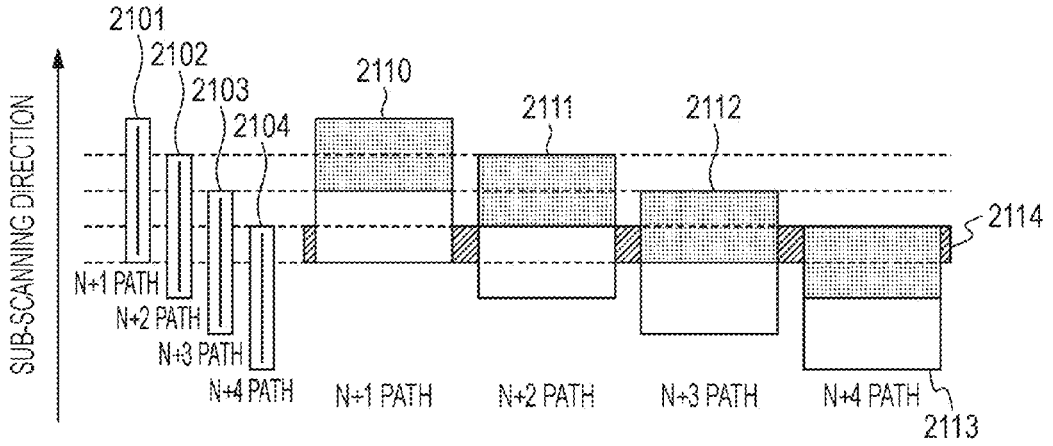

Based on the thus generated recording data for each scanning event, recording of the glossiness adjusting liquid is performed by at least one scanning event (S303), and then recording of the color ink is performed by the recording head 5 (S304). With reference to FIGS. 16A and 16B, how the mask pattern for the color ink used by the masking process unit 909 and the mask pattern for the glossiness adjusting liquid used by the masking process unit 910 are used during the multipath recording is described. In FIGS. 16A and 16B, a single color recording head is used for the ease of illustration.

The reference numerals 2101 to 2104 in FIGS. 16A and 16B collectively denote a single recording head. FIGS. 16A and 16B illustrate a state in which the position of the recording head is moved relative to the same region 2109 and 2114 of the recording medium as a recording medium is conveyed in the sub-scanning direction when 4-path multipath recording is performed. The reference numerals 2105 to 2109 denote a single mask pattern, and 2110 to 2114 denote a single mask pattern, illustrating a state in which the position of the mask pattern is moved relative to the same region 2109 and 2114 of the recording medium with respect to the recording head. FIG. 16A illustrates multipath recording using a mask pattern for the glossiness adjusting liquid. In the mask pattern for the glossiness adjusting liquid 2105 to 2109, ON pixels (black) in which dots are formed in accordance with the recording data are provided in the portion corresponding to upstream half in the sub-scanning direction of the recording head. That is, ON pixels (black) in which dots are formed in accordance with the recording data are provided in the portion corresponding to the (N+1)th path and the (N+2)th path with respect to the region 2109. ON pixels of the (N+1)th path and the (N+2)th path are complementary. In the (N+3)th path and the (N+4)th path with respect to the region 2109, no ON pixels exist, and OFF pixels (white) in which dots are not formed exist. In the mask pattern for the color ink 2110 to 2114, the entire region corresponding to the upstream half in the sub-scanning direction of the recording head are the OFF pixels (white) in which dot is not formed. That is, all the region corresponding to the (N+1)th path and the (N+2)th path with respect to the region 2114 are OFF pixels (white) in which dots are not formed. In the portion corresponding to the (N+3)th path and the (N+4)th path with respect to the region 2114, ON pixels (black) are provided, and the (N+3)th path and the (N+4)th path are complementary. Therefore, in the case of FIG. 16A, the glossiness adjusting liquid is recorded in the (N+1)th path and the (N+2)th path of the first half (S303). FIG. 16B illustrates multipath recording (S304) using the mask pattern for the color ink. In the case of FIG. 16B, an image is recorded with the color ink in the (N+3)th path and the (N+4)th path of the second half.

Figure 4A:
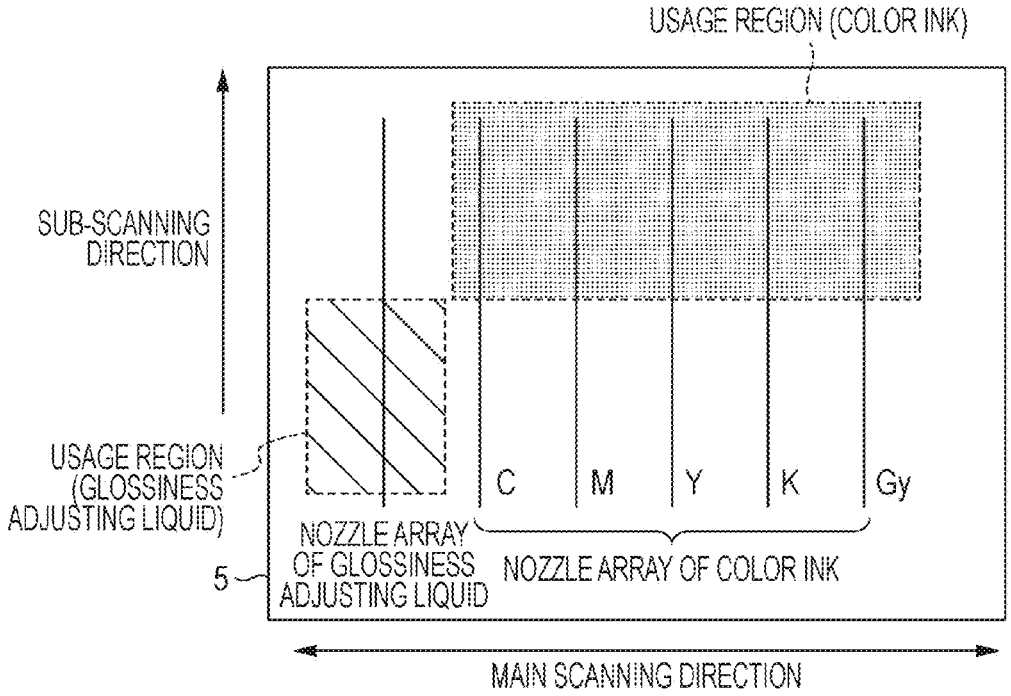
FIGS. 4A and 4B illustrate how to use a nozzle of the first embodiment.
Figure 4B:
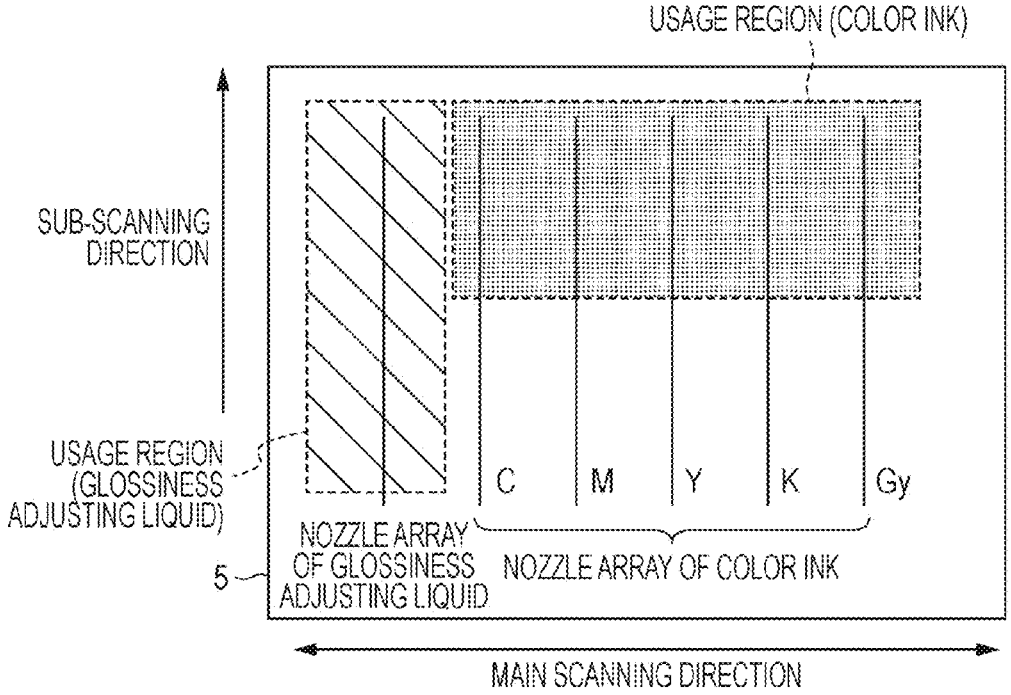

With reference to FIGS. 4A and 4B, how the color ink and the glossiness adjusting liquid are applied to the recording medium along the data processing flow described with reference to FIG. 1. FIGS. 4A and 4B are schematic perspective views of the recording head 5 seen from above toward the recording medium.

The recording head 5 has nozzle arrays constituted by nozzles for the color ink (C (cyan), M (magenta), Y (yellow), K (black), Gy (gray)) arranged in the sub-scanning direction and nozzle arrays constituted by nozzles for the glossiness adjusting liquid arranged in the sub-scanning direction. These nozzle arrays are arranged side-by-side in the main scanning direction in which the recording head 5 moves as illustrated in FIGS. 4A and 4B. In the case illustrated in FIG. 4A, the nozzle arrays for the glossiness adjusting liquid have a nozzle usage region restricted to the portion of the upstream half in the sub-scanning direction, and the nozzle arrays for the color ink have a nozzle usage region restricted to the portion of downstream half in the sub-scanning direction. In this manner, the glossiness adjusting liquid is recorded prior to the color ink. Alternatively, as illustrated in FIG. 4B, the entire nozzle may be defined as the usage region of the glossiness adjusting liquid, and the usage region of the nozzle arrays of the color ink may be restricted to the portion of the downstream half in the sub-scanning direction.

In this case, a mask pattern in which the ON pixels are provided over the entire sub-scanning direction of the nozzle array may be used for the recording with the glossiness adjusting liquid. In this case, when the ink is applied to the recording medium, the glossiness adjusting liquid is also applied.

If the user does not set to be the matt texture in S301, the application 901 sets to perform ordinary printing (S305). In this case, the inkjet recording apparatus 210 forms an image with the color ink (S306), and then applies the glossiness adjusting liquid to the recording medium on which the color ink image has been formed to adjust the glossiness (S307). In this case, in contrast to the form illustrated, for example, in FIG. 4A, the usage region of the nozzle arrays for the glossiness adjusting liquid is defined as the downstream half in the sub-scanning direction, and the usage region of the nozzle arrays for the color ink is defined as the upstream half in sub-scanning direction. Therefore, the glossiness adjusting liquid is recorded after the color ink is recorded. To achieve the above-described state, for the recording of the color ink, a mask pattern in which the ON pixels are provided only in the upstream half in the sub-scanning direction of the nozzle array as illustrated in FIG. 20A may be used. Further, for the recording of the glossiness adjusting liquid, a mask pattern in which the ON pixels are provided only in the downstream half in the sub-scanning direction of the nozzle array are illustrated in FIG. 20B may be used.

Usually, as the degree of matt texture increases, haze is decreased and transparency is lost, whereby a color gamut is reduced. The method of this specification, however, is effective also in reducing the color gamut.

Second Embodiment

In the present embodiment, dot arrangements of the glossiness adjusting liquid in a case in which the matt texture is provided are described.

To obtain a matt texture, it is effective to record a glossiness adjusting liquid first and then form an image with color ink. A further matt texture can be expressed with an improved dot pattern of the glossiness adjusting liquid.

To achieve a matt texture, no dot-on-dot arrangement per unit lattice regarding a dot on which the glossiness adjusting liquid is recorded (FIG. 5A) is effective. Compared with a dot-on-dot arrangement in which neighboring dots are recorded closely (FIG. 5B), a recording method in which dots are distributed in a manner so that their centers do not overlap with neighboring dots is more effective in expressing a matt texture. Regarding this effect, specular glossiness with respect to an amount of ink used per unit lattice is illustrated about a dot-on-dot case and a no dot-on-dot case with reference to FIG. 6.

A specific method for implementing a no dot-on-dot dot formation is described. Recording may be performed using the same apparatus as that of the first embodiment. In the present embodiment, a process flow of recording data is described in detail. A method may use a process in the dot pattern development unit 907. For example, when 2 dots of the glossiness adjusting liquid are recorded in 600 dpi unit lattice, if recording data is generated at 600 dpi, the dot target position during recording becomes the same (FIG. 5B) and the recording is performed by the dot-on-dot arrangement.

Figure 5A:
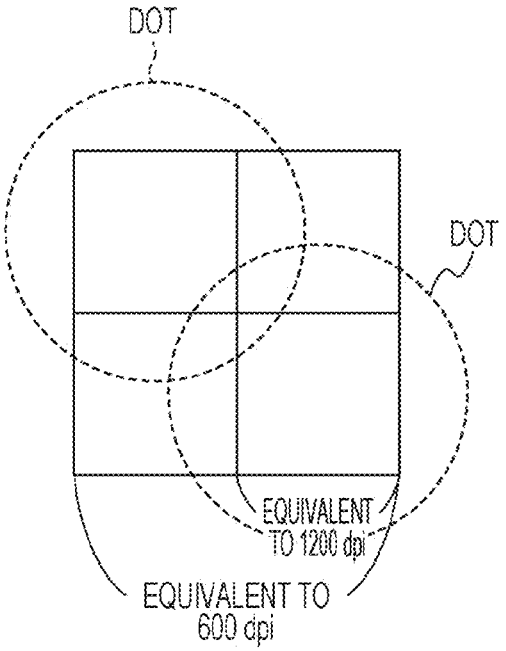
FIGS. 5A and 5B illustrate a dot arrangement on a recording medium according to a second embodiment.
Figure 5B:
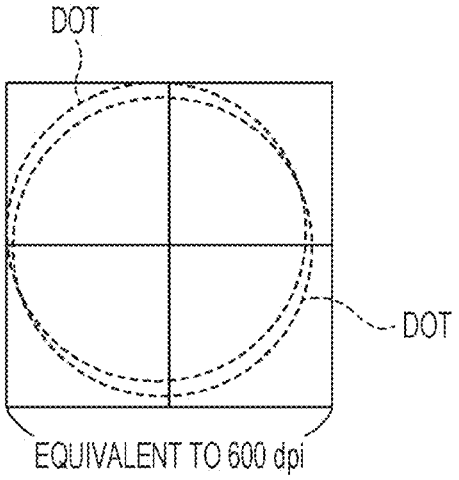
Figure 6:
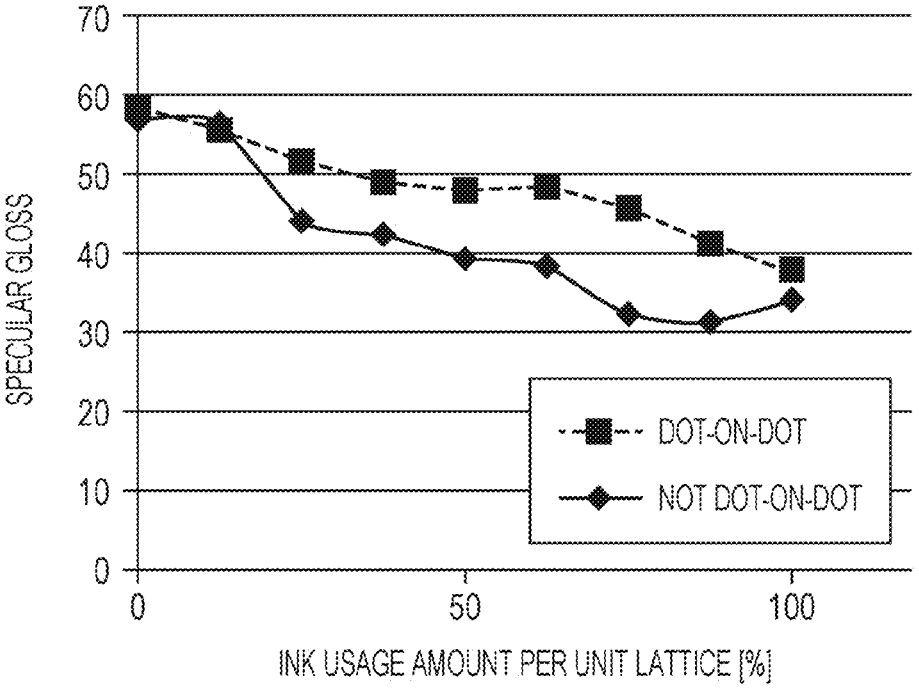
FIG. 6 illustrates an effect of the second embodiment.

However, if, for example, the unit lattice of the halftoning process unit 903 is set to 600 dpi and the process is performed such that the resolution becomes 1200 dpi after the process of the dot pattern development unit 908, dot targets are distributed and the dot-on-dot arrangement cannot be obtained (FIG. 5A). In this case, the effect of providing a further matt texture is higher in the case of FIG. 5A in which no dot-on-dot arrangement is obtained.

Third Embodiment

In the present embodiment, quantization for data generating to record dots of the glossiness adjusting liquid in the case of providing a matt texture is described.

The quantization process for generating recording data to record the glossiness adjusting liquid is performed by the halftoning process unit 904. The effect of providing a matt texture becomes higher as the resolution of quantization becomes higher. This is due to the effect of the recorded dots in a distributed manner as in the second embodiment.

Fourth Embodiment

Each embodiment of the present disclosure is to reproduce a texture by recording a glossiness adjusting liquid previously. The glossiness adjusting liquid is recorded previously to inhibit permeation, absorption, and fixing of color ink by the polymer included in the glossiness adjusting liquid, and changes surface roughness compared with a case where the glossiness adjusting liquid is not recorded previously. A higher effect can be obtained by recording the glossiness adjusting liquid by 9.5 pl or more at 600 dpi.

Glossiness adjustment for providing matt texture can be achieved also by the dot arrangement described in the second embodiment, quantization described in the third embodiment, and the amount of the glossiness adjusting liquid described in the present embodiment. Here, the no dot-on-dot recording method illustrated in FIG. 6 has been found to have an effect to reduce the gloss value greatly with a smaller usage amount of glossiness adjusting liquid. As described above, when the quantization resolution is lowered and optimized, the dots are effectively distributed.

That is, although the gloss value can be adjusted both by dot distribution and by an increase in the usage amount of the glossiness adjusting liquid, if the effect of reducing the usage amount of the glossiness adjusting liquid is also significant, it is desirable to adjust the usage amount of the glossiness adjusting liquid after optimizing the dot arrangement as in the second and the third embodiments. Therefore, it is possible to adjust the gloss value while reducing the usage amount of the glossiness adjusting liquid.

Figure 14:
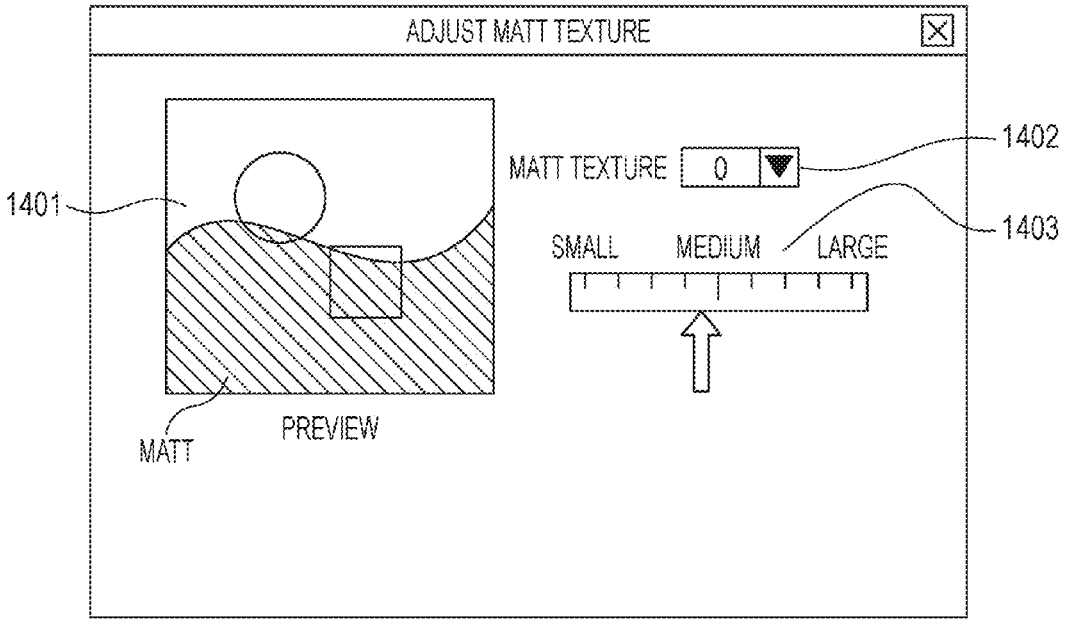
FIG. 14 illustrates an exemplary application screen according to an embodiment.

It is desirable to reflect the user's intention on the adjustment of the gloss value. On the application 901, the gloss value can be adjusted on an adjustment screen as illustrated in FIG. 14 with the user's intention reflected thereon. In FIG. 14, on a preview screen 1401, the user designates a region to which the matt texture is added (a hatched part), and designates whether the matt texture is added using a matt texture addition designation switch 1402 (0: not designate; 1: designate). If the matt texture is added, the intensity of the matt texture is designated using a matt intensity adjustment bar 1403. Depending on the setting on the UI, the dot arrangement and the ink usage amount are adjusted inside a printer and the optimum matt texture is expressed by the method described in the above embodiments.

That is, the degree of mattness can be increased or decreased.

Fifth Embodiment

In the present embodiment, a recording method in a case where an object to be matt and an object to be kept glossy exist at the same time on the same surface of a recording medium is described.

Figure 7:
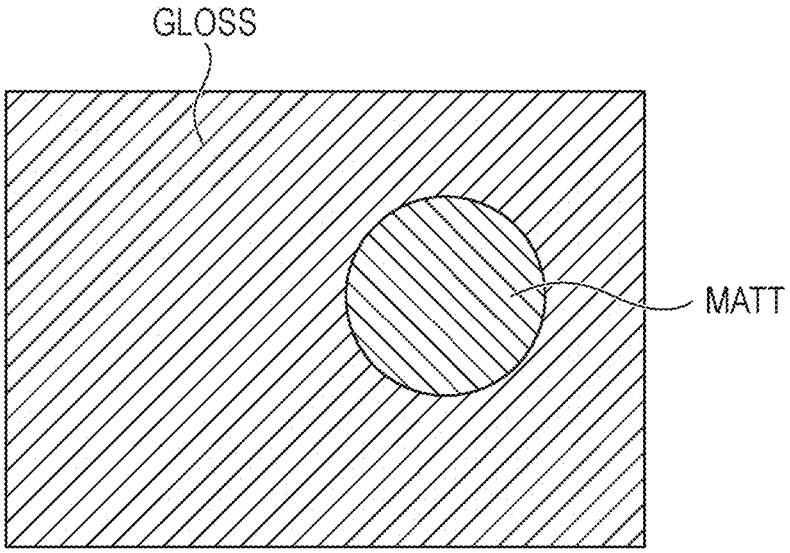
FIG. 7 illustrates an object within a medium according to a fifth embodiment.

FIG. 7 is a concept diagram of a case where two regions (i.e., objects) of different textures are to exist on the same paper sheet. If an image in which an object of a matt texture is drawn only in a specific region in a highly glossy region (a glossy region in FIG. 7), user's creation intention can be reproduced to a high degree, which is effective.

In the present embodiment, the glossiness adjusting liquid is applied only to the specific object part prior to the color ink and, the glossiness adjusting liquid is applied after the color ink in the portion to be glossy. The previous/subsequent application of the glossiness adjusting liquid and the color ink can be performed by the methods described in the first embodiment.

Figure 15:
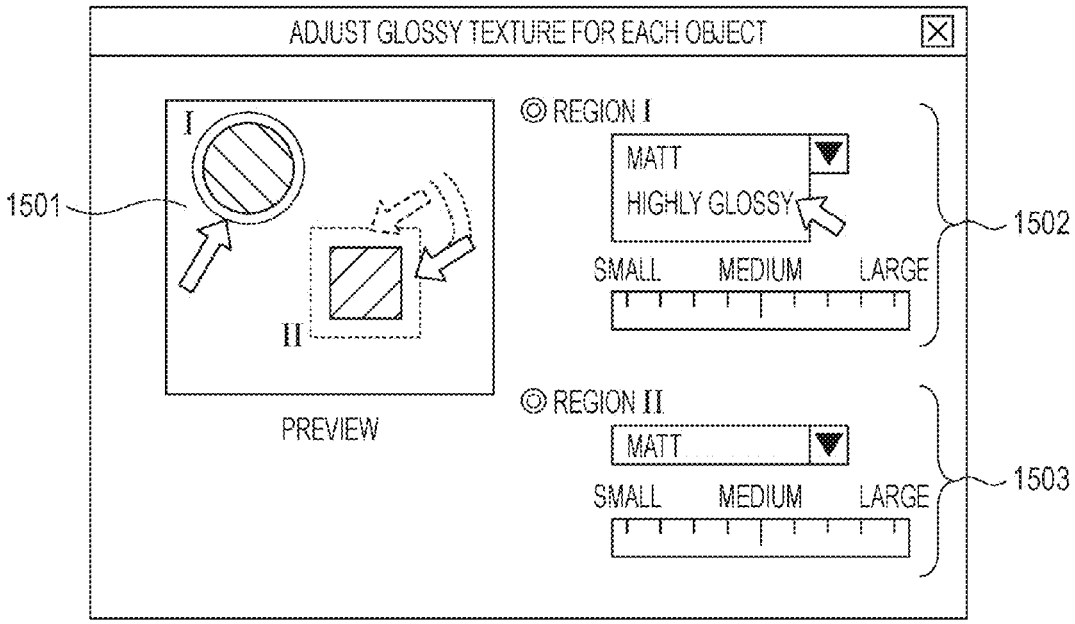
FIG. 15 illustrates an exemplary application screen according to an embodiment.
Figure 20:
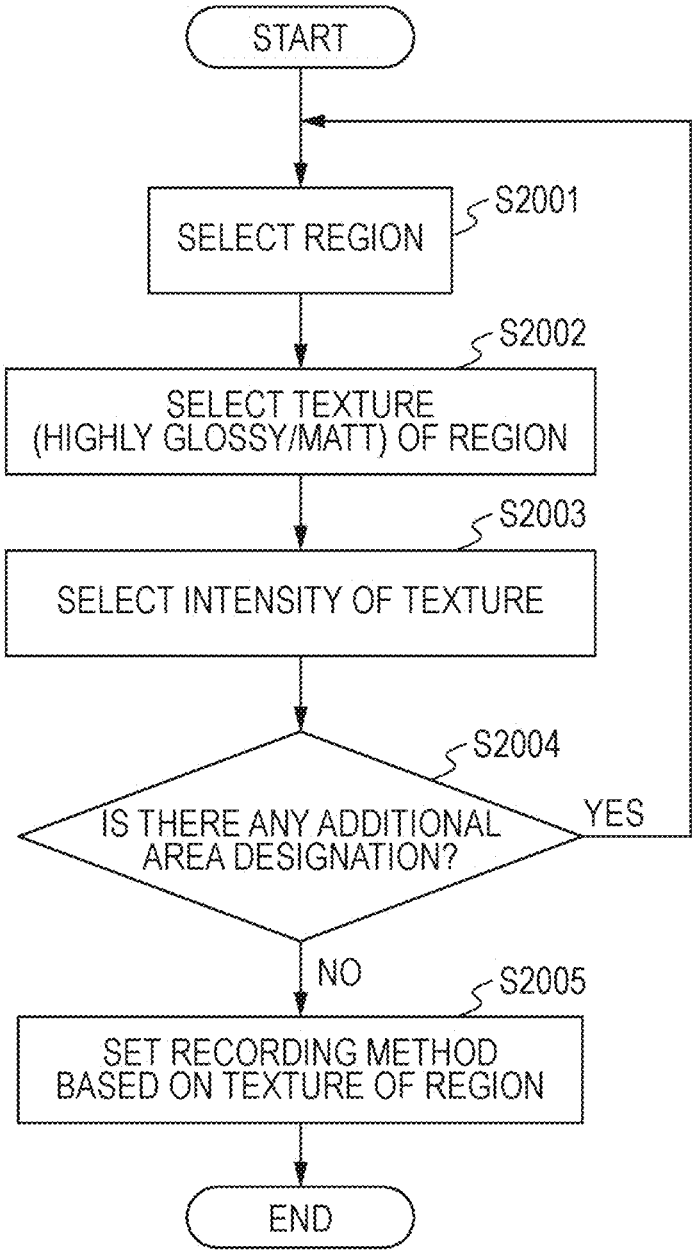
FIG. 20 is a flowchart according to an embodiment.

With reference to FIG. 20, a flowchart illustrating a process flow of the present embodiment is described. For example, in S2001, the user first designates objects and regions to be matt or highly glossy on a preview 1501 of the UI in a display device connected with the host apparatus 110 as illustrated in FIG. 15, then, in S2002 and S2003, makes adjustment for each region with an adjustment switch and an adjustment bar (1502, 1503). The adjustment may be made on an object basis or a region may be designated by surrounding using a cursor on the preview screen. If an additional region is designated in S2004, the process returns to S2001, and if not, the process proceeds to S2005 where recording is performed.

In this case, a matt part can be provided on a glossy medium with glossy surface, such as glossy paper and, on the contrary, a highly glossy part can be provided amongst other matt parts. A glossy part and a matt part can be realized on a single recording medium.

Figure 8:
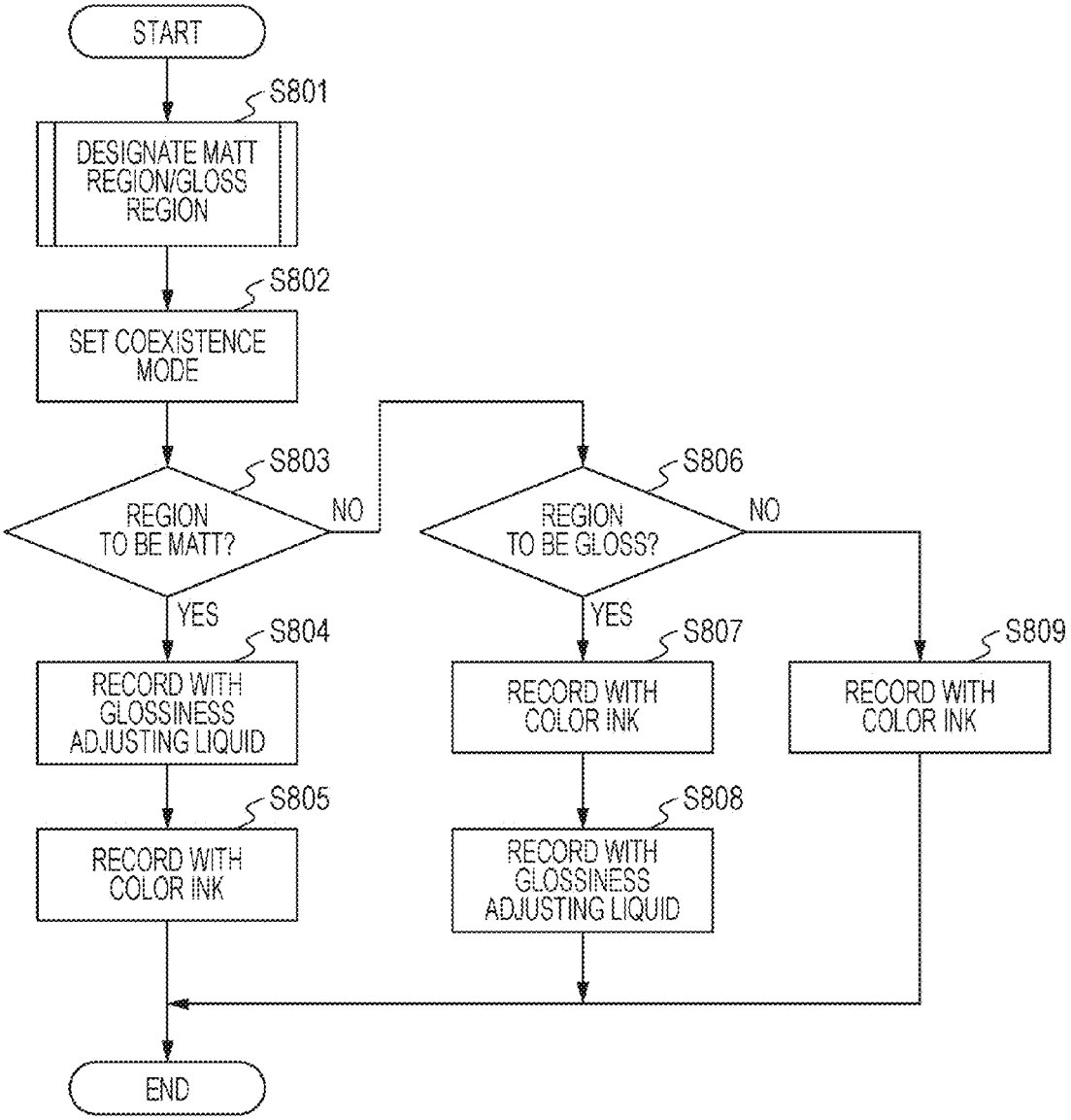
FIG. 8 is a flowchart of a recording method according to the fifth embodiment.
Figure 9:
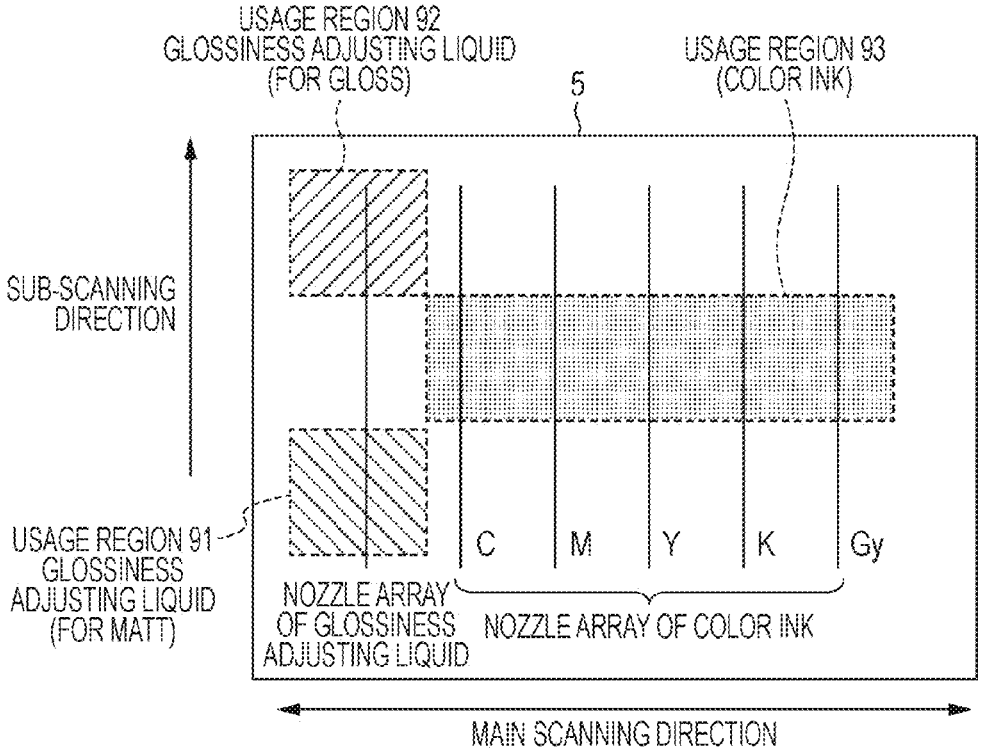
FIG. 9 illustrates a usage region of a nozzle according to the fifth embodiment.

In this case, recording can be performed along the flowchart of FIG. 8. In S801, the user designates the regions that are to be matt or glossy on the UI in a display device connected with the host apparatus 110. S801 corresponds to S2001 to S2004 (FIG. 20) described above. For example, the user designates the regions by selecting the regions on the preview in a window of a printer driver displayed in accordance with signals from the PC. The user issues a recording instruction via the application 901, and the area selection is performed in S801. If it is indicated by the recording instruction from the application that both the glossy and matt regions exist on the same surface of a single recording medium, the inkjet recording apparatus 210 sets in S802 to execute a coexistence mode in which two types of glossy expressions exist on the same surface. S802 corresponds to S2005 described above. FIG. 9 is a diagram illustrating the usage region of the nozzle arrays similar to FIGS. 4A and 4B. In the present embodiment, this configuration is realizable by employing the usage of nozzles as illustrated in FIG. 9.

As illustrated in FIG. 9, in the coexistence mode in the matt part and the highly glossy part are formed on the same recording medium, each nozzle array is used in three groups. The groups are, from the upstream in the sub-scanning direction, a usage region 91 of the nozzle array for the glossiness adjusting liquid (for the matt region), a usage region 93 for the color ink, and a usage region 93 of nozzle array for the glossiness adjusting liquid (for the glossy region). Setting of the usage region is realizable by disposing ON pixels only at portions corresponding to the usage region of the nozzle array in the mask pattern corresponding to each nozzle array as described in the first embodiment. The application 901 generates data of the glossiness adjusting liquid for the matt region and data of the glossiness adjusting liquid for the glossy region as separate multi-valued data. After each multi-valued data is deployed as a dot pattern, a mask pattern for using the usage region 91 in the dot data for the matt region, and a mask pattern for using the usage region 92 in the dot data for the glossy region are applied in the masking process unit 910.

S803 to S808 of FIG. 8 describes operations which the controller 100 makes the printer execute. In the following description, S801 to S808 are steps illustrated in FIG. 8, and the nozzle usage regions are those illustrated in FIG. 9.

First, in S803, if the region where the recording head 5 performs recording is a region to be matt, a pattern for matt is recorded on a portion where matt is to be reproduced in the usage region 91 of the nozzle array for the glossiness adjusting liquid (S804). Next, an image is recorded with color ink of a plurality of colors in the usage region 93 of the nozzle arrays of the color ink located downstream in the sub-scanning direction of the usage region 91 (S805). Depending on the color to be formed, a single color may be used. If, in S806, the region where the recording is performed is a region to be glossy, an image is recorded with color ink of a plurality of colors in the usage region 93 of the nozzle arrays of color ink (S807). Next, the glossiness adjusting liquid is applied on the image of color ink in the usage region 92 (S808). If the region to be recorded with the recording head in S806 is neither matt nor glossy, an image is recorded with color ink in an amount determined depending on the data of the corresponding image.

Figure 10:
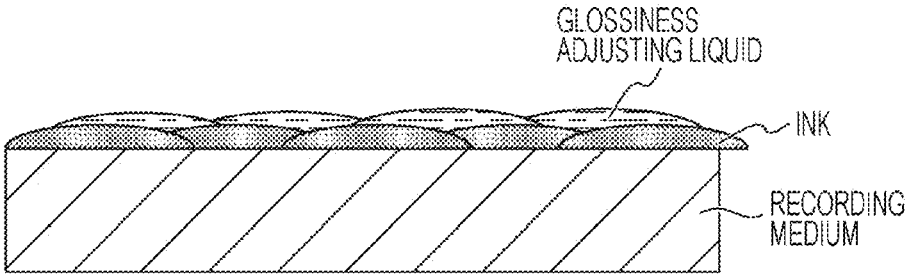
FIG. 10 illustrates a cross section of a recording medium according to the fifth embodiment.

Here, a cross-sectional view of a state of the recording medium after recording by applying the color ink and the glossiness adjusting liquid in this order to achieve highly glossy by S807 and S808 is illustrated in FIG. 10. By recording the glossiness adjusting liquid on the color ink (C, M, Y, K, Gray) that has been recorded, a smooth surface and highly glossy are achieved.

Alternatively, the matt part and the highly glossy part may coexist on the same recording medium by the following method. For example, the recording medium may be discharged after the glossiness adjusting liquid for matt is recorded, and then the recording medium may be placed again for the recording of the color ink to the matt part and the color ink to the highly glossy part, and recording of the glossiness adjusting liquid. However, the above-described method in which the nozzle arrays are grouped into the usage regions to record the color ink and the glossiness adjusting liquid uses smaller amount of operations to feed and convey the recording medium and, therefore, misalignment between the matt part and other part and between the glossy part and other part can be reduced.

Even if the matt part and the other part coexist on the same recording medium, when no highly glossy part needs to be formed in the medium, it is not necessary to use the nozzle in a manner such that only the glossiness adjusting liquid is recorded after the application of the color ink is completed. In that case, the throughput becomes higher by using the nozzle in a manner illustrated in FIGS. 4A and 4B than by using as illustrated in FIG. 9. The usage of the nozzle is selected depending on the user's designation as described above.

Sixth Embodiment

The present embodiment is an application of a method for changing a glossy texture into a matt texture by using a glossiness adjusting liquid. In the present embodiment, an improved pattern of the glossiness adjusting liquid is used to enhance a user's expressive possibility. Specifically, patterns that reproduce textures of various media are recorded as recording patterns of the glossiness adjusting liquid. Therefore, a pattern appears on the recording medium to reproduce a texture as if it is recorded on another medium. Specifically, textures of various media, such as canvas, random embossed paper, drawing paper, and Japanese paper, are reproducible.

Figure 17A:
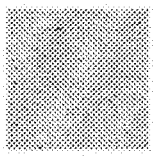
FIGS. 17A to 17C illustrate exemplary medium patterns according to the sixth embodiment.
Figure 17B:
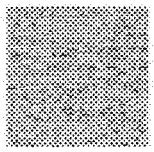
Figure 17C:
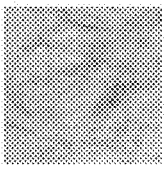

The examples are illustrated in FIGS. 17A to 17C. FIG. 17A is a texture reproduced a denim fabric texture, FIG. 17B is a texture reproduced a canvas texture, and FIG. 17C is a texture reproduced a Japanese paper texture. Such data is made to synchronize with data for the recording of the glossiness adjusting liquid before recording, whereby reproduction of the texture of the recording medium is achieved.

The pattern corresponding to the surface roughness information on the specific medium for reproducing the texture of the specific medium can be stored in the application 901 previously, and may be selected by the user. The roughness information may be acquired from the recorded image, stored in a storage unit of the host apparatus, and may be used.

The roughness information may be acquired by, for example, the following method. First, projecting portions on a white recording medium are lightly colored with, for example, a pencil and white and black information is read with an optical apparatus to acquire information easily. In this case, the portions colored in black with a pencil are the projecting portions, which are to be portions where the glossiness adjusting liquid is to be applied. The white and black information acquired and stored in the storage unit can be used as pattern information by the application 901.

Figure 11A:
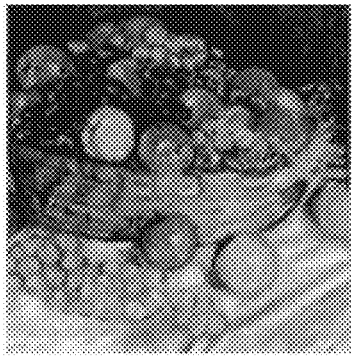
FIGS. 11A and 11B are concept diagrams about roughness information on various recording media according to a sixth embodiment.
Figure 11B:
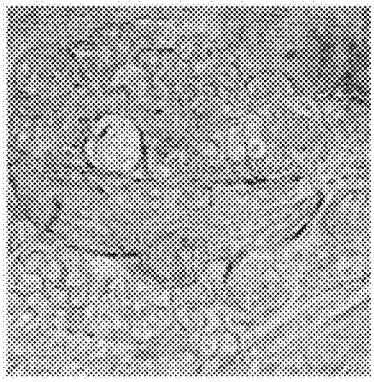

This is described in detail with reference to FIGS. 11A and 11B. FIG. 11A illustrates an image to be recorded on the recording medium and is an image drawn on the canvas. Suppose that this image is recorded on a highly glossy recording medium. In that case, the user's intention is further satisfied if the texture of the recording medium can be a canvas tone. In that case, to control glossiness and to change appearance of the recording medium into a canvas tone, roughness information of the specific medium is acquired as white and black information as illustrated in FIG. 11B. In this case, the black portions are processed as the projecting portions. As this method, the image drawn on the canvas may be read to acquire roughness information as described previously, or original image data may be processed using the application 901, and generated data may be used. The user can determine each time which color, black or white, corresponds to the projecting portion depending on the acquisition method.

Figure 12:
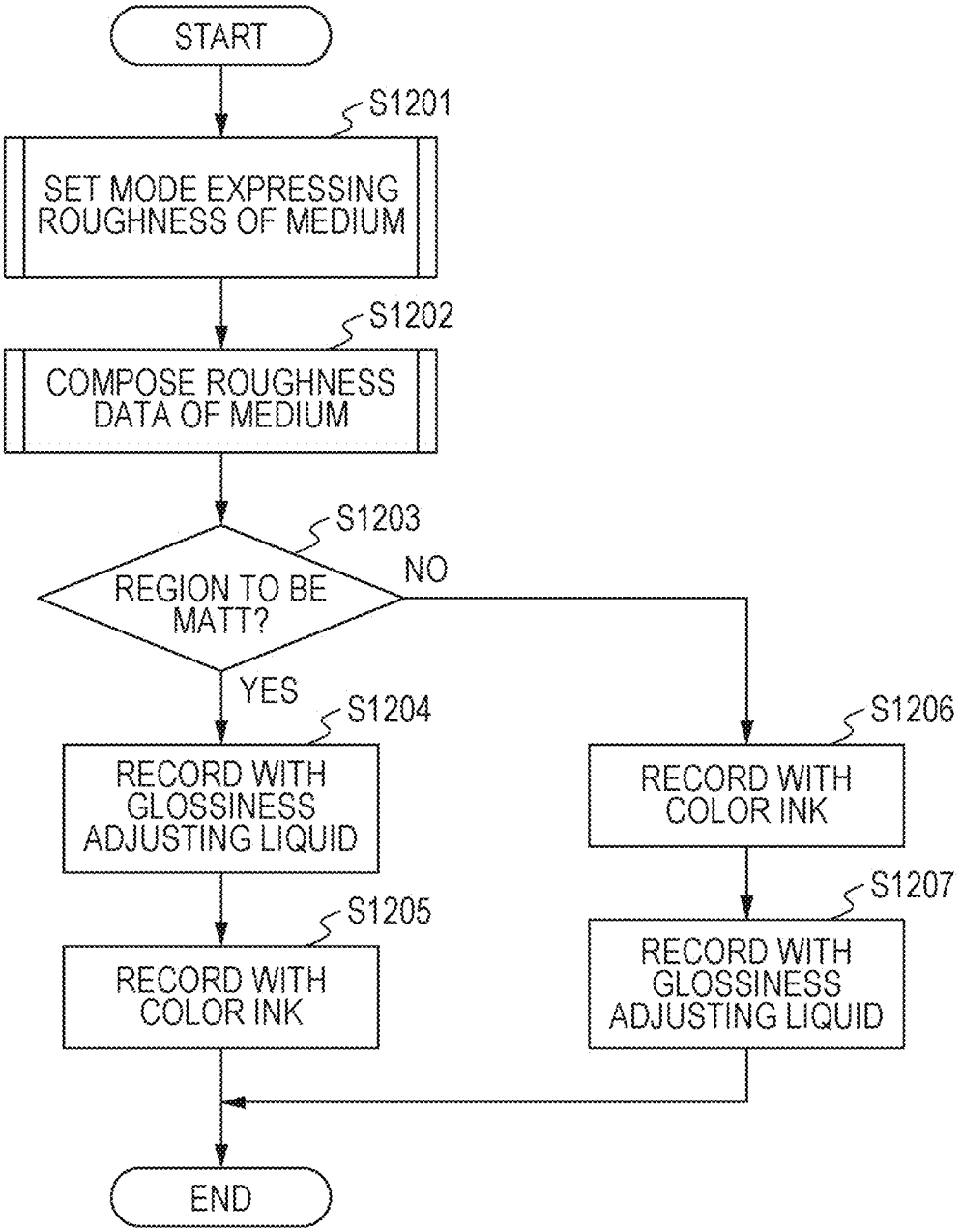
FIG. 12 is a flowchart of a recording method according to the sixth embodiment.

These are described with reference to FIG. 12. FIG. 12 is a flowchart illustrating the present embodiment. In S1201, the user sets a mode of reproducing surface roughness of a specific medium using the application 901. If the mode of reproducing surface roughness of a specific medium is set, in S1202, data of a pattern of the roughness of the medium is prepared by the application 901, and is composed into an image data. This composition can be attained by, for example, composing to data of the glossiness adjusting liquid after halftoning in the host apparatus 110.

This process is performed simultaneously with the driver process S102.

Then, recording with the glossiness adjusting liquid is performed based on the data after composition in the region to be matt in S1203 (S1204), and then recording with the color ink is performed (S1205). In the region to be matt, recording with the color ink is performed (S1205), and then recording with the glossiness adjusting liquid is performed (S1207). The flow of this recording can be executed in the same manner as described in the fourth embodiment. Alternatively, a texture of a medium surface to be reproduced may be selected for each region (e.g., a part is canvas tone and a part is drawing paper tone), and the degree of each texture may be set on such a UI as illustrated in FIG. 15.

Other Embodiments

As the methods for applying the glossiness adjusting liquid and the ink in this order to the recording medium as described in the embodiments above, roller coating may also be used in addition to the nozzle division printing or double-passage of the recording medium through the apparatus.

These methods can change glossiness without changing the recording medium and can enhance user's expressive possibility.

EFFECTS OF INVENTION

According to the present disclosure, compared with the related art methods, the glossiness control range can be increased, and can form an image with a more matt texture on a recording medium.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2014-238251, filed Nov. 25, 2014 which is hereby incorporated by reference herein in its entirety.

What is claimed is:

1. A recording apparatus comprising:

a recording unit including a first nozzle array in which a plurality of nozzles for ejecting color ink are arranged in a predetermined direction for applying the color ink to a recording medium to record an image on the recording medium, and a second nozzle array in which a plurality of nozzles for ejecting an adjusting liquid are arranged in the predetermined direction, wherein the adjusting liquid is substantially transparent and colorless and is applied to the recording medium for adjusting a degree of surface roughness of the image formed on the recording medium, the adjusting liquid including a greater amount of polymer having a function of adjusting glossiness than a polymer having a function of adjusting glossiness in the color ink, wherein the first nozzle array and the second nozzle array are arranged in a cross direction crossing the predetermined direction;

a moving unit configured to move the recording unit relative to the recording medium in the cross direction; and a conveying unit configured to convey the recording medium in the predetermined direction, wherein the movement of the first and the second nozzle arrays with respect to the recording medium by the moving unit and the movement of the recording medium by the conveying unit are performed alternately, and wherein the recording unit applies the color ink to a first region and a second region which is different from the first region on the recording medium from a part of nozzles of the first nozzle array without using other parts of the first nozzle array, and applies the adjusting liquid to the first region using a nozzle of the second nozzle array provided upstream in a conveyance direction of the recording medium than a part of nozzles of the first nozzle array for applying color ink to the first region without using other parts of the second nozzle array, and applies the adjusting liquid to the second region using a nozzle of the second nozzle array provided downstream in the conveyance direction of the recording medium than a part of nozzles of the first nozzle array for applying the color ink to the second region without using other parts of the second nozzle array so that the color ink is provided on the adjusting liquid without adjusting liquid on the color ink in the first region and the color ink is provided with adjusting liquid on the color ink and without adjusting liquid under the color ink in the second region.

2. The recording apparatus according to claim 1, wherein the recording unit applies the adjusting liquid in a manner such that a center of a first dot of the adjusting liquid applied on the recording medium does not overlap a second dot of the adjusting liquid that adjoins the first dot.

3. The recording apparatus according to claim 1, wherein the color ink includes ink of a plurality of different colors.

4. A recording system comprising:

a setting unit configured to cause a display device to display a window for setting a matt region for reproducing a matt tone and a glossy region for reproducing a glossy tone in a recording medium by a user;

a recording apparatus configured to record an image on the recording medium according to the setting by the user in the setting unit and comprising a recording unit including a first nozzle array in which a plurality of nozzles for ejecting color ink are arranged in a predetermined direction for applying the color ink to a recording medium to record an image on the recording medium, and a second nozzle array in which a plurality of nozzles for ejecting an adjusting liquid in the predetermined direction, wherein the adjusting liquid is substantially transparent and colorless and is applied to the recording medium for adjusting a degree of surface roughness of the image formed on the recording medium, the adjusting liquid including a greater amount of polymer having a function of adjusting glossiness than a polymer having a function of adjusting glossiness in the color ink and wherein the first nozzle array and the second nozzle array are arranged in a cross direction crossing the predetermined direction;

a moving unit configured to move the recording unit relative to the recording medium in the cross direction; and a conveying unit configured to convey the recording medium in the predetermined direction, wherein the movement of the first and the second nozzle arrays with respect to the recording medium by the moving unit and the movement of the recording medium by the conveying unit are performed alternately, and wherein the recording unit applies the color ink to a first region as a set matt region and a second region as the set glossy region which is different from the first region on the recording medium from a part of nozzles of the first nozzle array without using other parts of the first nozzle array, and applies the adjusting liquid to the first region using a nozzle of the second nozzle array provided upstream in a conveyance direction of the recording medium than a part of nozzles of the first nozzle array for applying color ink to the first region without using other parts of the second nozzle array, and applies the adjusting liquid to the second region using a nozzle of the second nozzle array provided downstream in the conveyance direction of the recording medium than a part of nozzles of the first nozzle array for applying the color ink to the second region without using other parts of the second nozzle array so that the ink is provided on the adjusting liquid without adjusting liquid on the color ink in the first region and the color ink is provided with adjusting liquid on the color ink and without adjusting liquid under the color ink in the second region.

5. The recording system according to claim 4, wherein the setting unit is further capable of setting a degree of matt tone reproduced in the matt region and a degree of glossy tone reproduced in the glossy region through the window.

6. The recording apparatus according to claim 1, wherein the recording unit applies the color ink to the first region and the second region by a plurality of times of the movement by the moving unit and applies the adjusting liquid to the first region and the second region by a plurality of times of the movement by the moving unit.

7. The recording system according to claim 4, wherein the recording unit applies the color ink to the first region and the second region by a plurality of times of the movement by the moving unit and applies the adjusting liquid to the first region and the second region by a plurality of times of the movement by the moving unit.

8. The recording system according to claim 4, further comprising a data generating unit configured to generate data used for applying the adjusting liquid by the recording unit, wherein the setting unit is further configured to receive input for reproducing at least one of a denim fabric texture, a canvas texture, and a Japanese paper texture from user, wherein the generating unit generates the data based on the received input.

* * * * *